US006059113A

United States Patent [19]

Hodges

[11] Patent Number: 6,059,113

[45] Date of Patent: May 9, 2000

[54] DISPLAY PACKAGE WITH CORRUGATED INSERT

[75] Inventor: Jerry Don Hodges, Boulder, Colo.

[73] Assignee: Shoyeido Corporation, Boulder, Colo.

[21] Appl. No.: 08/897,506

[22] Filed: Jul. 21, 1997

[51] Int. Cl.[7] ..... B65D 85/20; B65D 5/38

[52] U.S. Cl. ..... 206/443; 206/459.5; 206/782; 206/784; 229/149

[58] Field of Search ..... 206/214, 371, 206/443, 256–258, 775–778, 784, 782, 756, 758, 761, 459.5; 229/149

[56] References Cited

U.S. PATENT DOCUMENTS

| | | | |
|---|---|---|---|
| 540,268 | 6/1895 | Newell | 206/443 |
| 543,991 | 6/1895 | Johnson . | |
| 624,583 | 5/1899 | Vierengel | 229/149 |
| 820,773 | 5/1906 | Fleming | 206/371 X |
| 924,094 | 6/1909 | Myers | 229/149 |
| 1,130,811 | 3/1915 | Goldsmith | 206/371 X |
| 1,217,283 | 2/1917 | Daniel et al. | 206/443 |
| 1,249,184 | 4/1917 | Parmenter . | |
| 1,433,439 | 10/1922 | Weis | 229/149 |
| 1,490,529 | 4/1924 | Dittgen . | |
| 1,545,487 | 7/1925 | Croft | 206/459.5 |
| 1,586,497 | 5/1926 | James | 206/443 |
| 1,744,388 | 1/1930 | Johnson | 206/443 |
| 1,924,823 | 8/1933 | Willi . | |
| 2,450,089 | 9/1948 | Hiergesell et al. | 206/777 X |
| 2,517,767 | 8/1950 | Cody . | |
| 2,551,012 | 5/1951 | Kenal | 206/443 X |
| 2,711,819 | 6/1955 | Lugt . | |
| 2,789,689 | 4/1957 | Lewis . | |
| 2,885,071 | 5/1959 | Rodnon . | |
| 2,941,662 | 6/1960 | Osberg | 206/422 X |
| 3,047,135 | 7/1962 | Miller | 206/459.5 X |
| 3,051,345 | 8/1962 | Flynn . | |
| 3,265,204 | 8/1966 | Wozniak | 206/443 |
| 3,369,859 | 2/1968 | Cornelius | 206/443 X |
| 3,587,837 | 6/1971 | Smith et al. | 206/777 X |
| 3,756,496 | 9/1973 | Oostdik . | |
| 3,849,932 | 11/1974 | Adams . | |
| 3,960,315 | 6/1976 | Dobbins . | |
| 4,186,835 | 2/1980 | Hofer | 206/443 |
| 4,515,838 | 5/1985 | Miyajima | 229/928 X |
| 4,754,916 | 7/1988 | Knight, Jr. . | |
| 5,333,778 | 8/1994 | Specker . | |
| 5,575,385 | 11/1996 | Zona . | |

FOREIGN PATENT DOCUMENTS

| | | | |
|---|---|---|---|
| 0 441 757 | 8/1991 | European Pat. Off. . | |
| 381551 | 1/1908 | France | 206/443 |
| 684094 | 3/1930 | France | 206/443 |
| 2 689 097 | 10/1993 | France . | |
| 90 02 315 U | 5/1990 | Germany . | |
| 292 567 | 11/1928 | United Kingdom . | |

*Primary Examiner*—Bryon P. Gehman
*Attorney, Agent, or Firm*—Greenlee, Winner and Sullivan, PC

[57] ABSTRACT

A package for simultaneously protecting and displaying fragile products or items of merchandise, particularly items having the form of slender rods. The package comprises a carton having a window and containing a corrugated insert. The window permits viewing the products in the package while the corrugated insert provides separation and protection for the individual products. The carton and the insert are each folded from a single blank.

13 Claims, 6 Drawing Sheets

DISPLAY PACKAGE WITH CORRUGATED INSERT

FIELD OF THE INVENTION

This invention is a package for protecting and displaying fragile merchandise.

BACKGROUND OF THE INVENTION

It is often desirable to enclose fragile products, or items of merchandise, in a package which both provides protection for the products and is suitable for displaying the products in a manner attractive to the customer. The protection capability is especially important when the products are unwieldy as well as fragile. The display capability is important when the products are available in different colors or designs and when the customer's decision to purchase depends on seeing the products.

Packages for protecting fragile products during shipping and handling are widely known in the art. For example, U.S. Pat. Nos. 543,991, 1,249,184, 1,490,529, 2,517,767, 2,885,071, 3,051,345, 3,756,496, 4,754,916 and 5,575,385 disclose packages for separating or protecting various products.

U.S. Pat. No. 3,849,932 discloses apparatus, for starting plants from seeds, which uses a corrugated trough.

A package comprising a compartmented tubular member for containing and displaying small articles is disclosed in U.S. Pat. No. 1,924,823.

U.S. Pat. No. 2,711,819 discloses a compartment carton designed to receive and display dishes and utensils such as forks and spoons.

A package which provides for containing and displaying a product such as bacon is disclosed in U.S. Pat. No. 3,960,315.

U.S. Pat. No. 5,333,778 discloses a package with integrated partitioning for acceptance and display of longitudinal objects.

Each of the previously cited inventions serves a particular need. However, there remains a need for a simple and inexpensive package which can simultaneously protect and display fragile products, particularly products having slender, rod-like shapes. For example, sticks of incense are often several inches in length and less than one-eighth of an inch in diameter. Such incense sticks are quite brittle and easily broken by slight flexing. Also, such incense sticks are often color coded as to the fragrance they produce. Consequently, there is a need for a package which can provide separation and protection for individual sticks of incense and which can also simultaneously provide a view of the colors or styles of the individual sticks to a customer or user of the incense.

It is therefore an object of this invention to provide a simple and inexpensive package for separating and protecting fragile products while simultaneously permitting the products contained in the package to be viewed.

SUMMARY OF THE INVENTION

This invention is a package comprising a carton having a display window and containing a corrugated insert. The corrugated insert is preferably accordion-pleated and, when placed within the carton, partitions the carton into elongated compartments each having a preferably triangular cross section. The compartments provide separation and protection for fragile products, especially products having the form of long slender rods. The display window is located in a front panel of the carton and permits a view of at least a portion of the products held in position behind the window by the corrugated insert. Optionally another window may also be provided in a rear panel of the carton.

The corrugated insert of the invention provides multiple troughs, preferably having V-shaped or otherwise tapered cross sections, for cradling and supporting fragile products, particularly long slender products such as incense sticks, during shipment and handling of the package. The carton surrounding the insert holds the products in place by closing the open sides of the troughs and provides a window for viewing the products resting in the troughs. Text may be printed on surfaces of the insert within the troughs, preferably to provide information about the individual products resting in the troughs.

The carton and the insert are each made by folding from a single blank cut from a sheet of flat material. Assembly of the package is completed by sliding the insert into the carton. One or more windows is formed in the carton when its blank is cut. Optional transparent window panels may be attached to the carton blank before it is folded.

The invention provides a very simple and inexpensive package for simultaneously protecting and displaying fragile products. Since the carton box and the insert are each folded from a single sheet of material and the insert is easily inserted into the carton, the package is inexpensive to manufacture. Although simple to manufacture, the package provides protection and support for fragile slender rods while presenting them for view in the window of the carton.

DESCRIPTION OF THE PREFERRED EMBODIMENT

Figure 1:
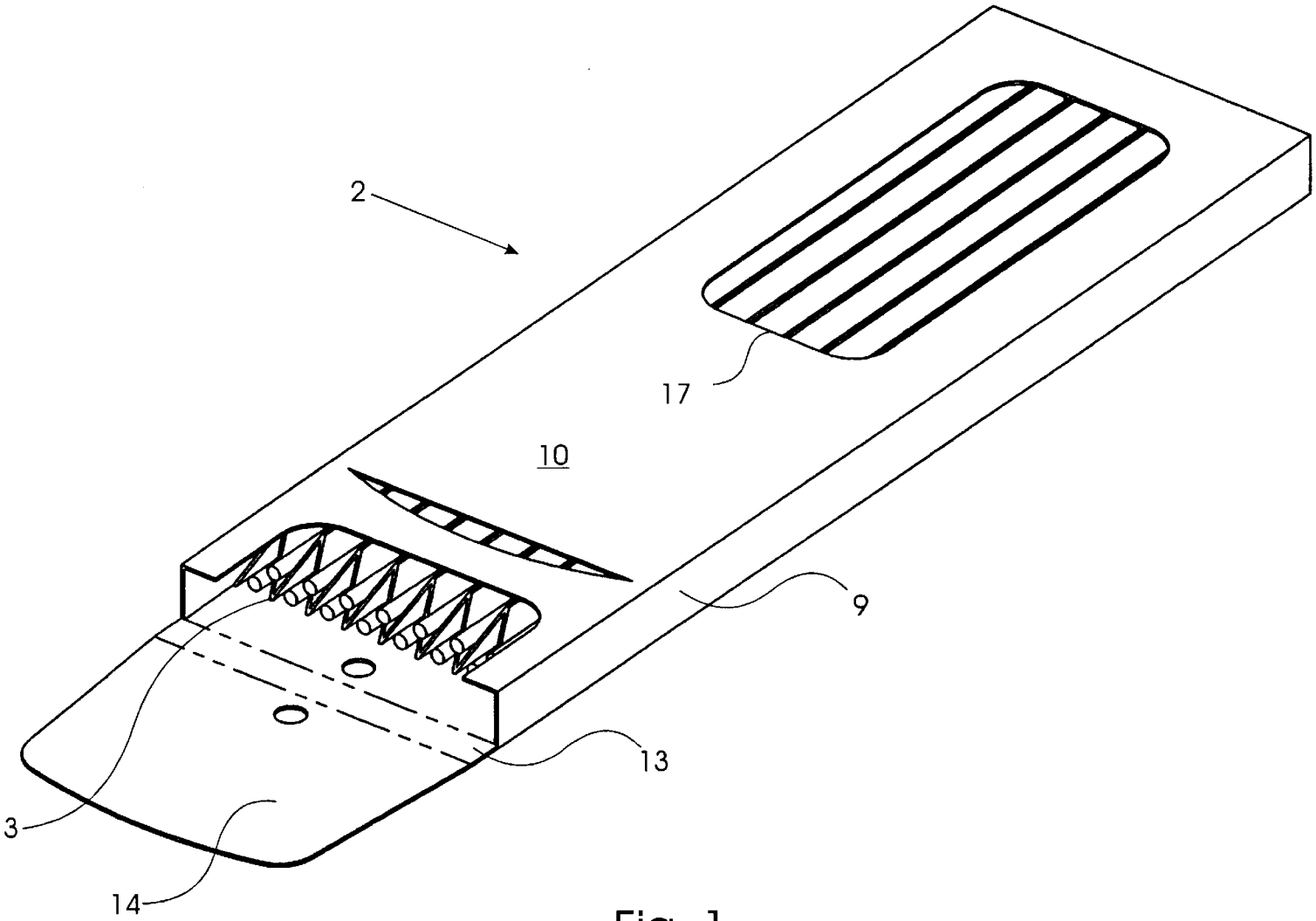
FIG. 1 is a perspective view of the package.

A perspective view of a preferred embodiment of the invention is shown in FIG. 1. This view shows the entire package comprising carton 2, corrugated insert 3 and window 17. A second window (18 in FIG. 4) opposite window 17 is not visible in this view. This view also shows front panel 10, side panel 9, top end panel 13 and top tab panel 14.

Figure 2:
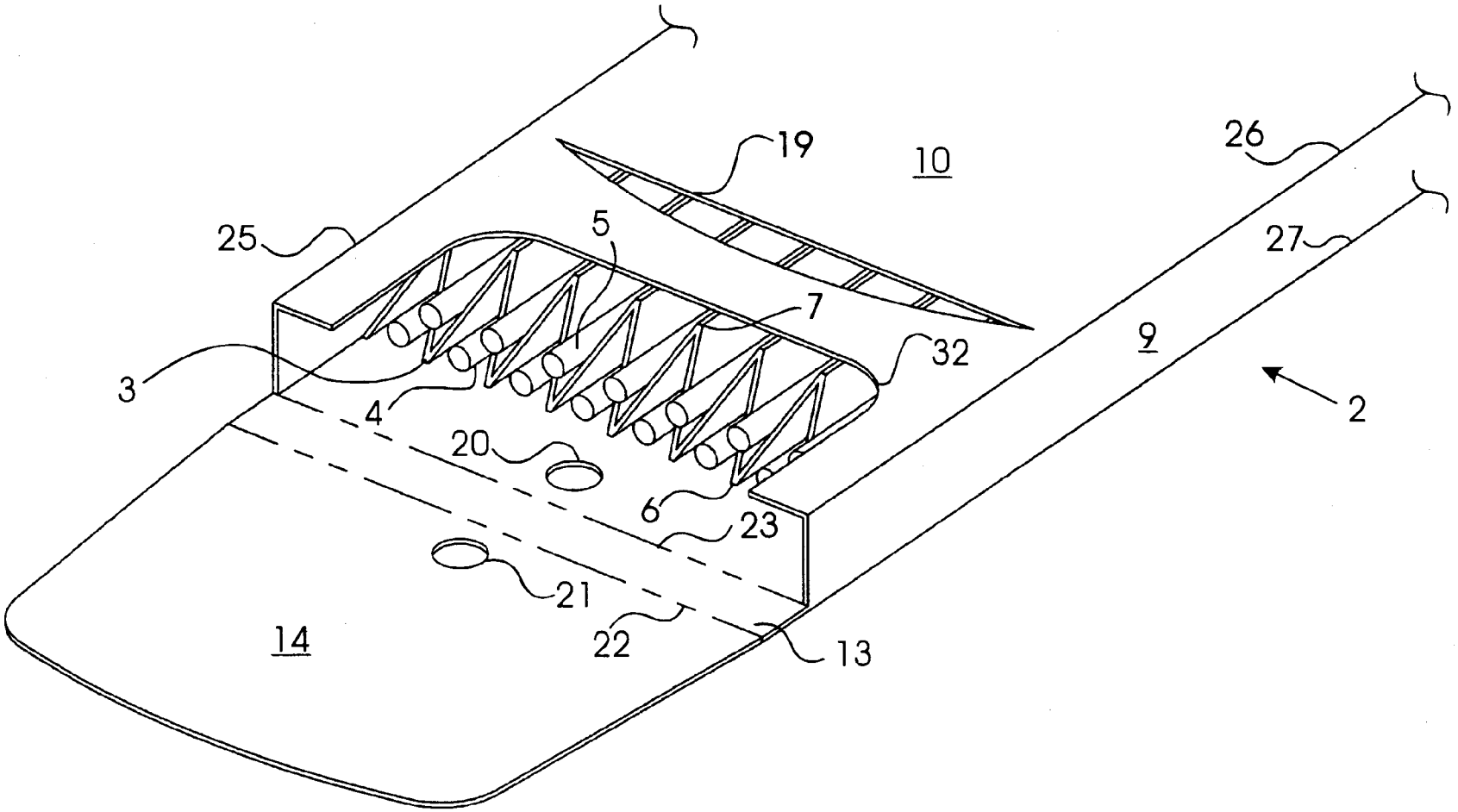
FIG. 2 is an enlarged view of an open end of the carton.

FIG. 2 is an enlarged view of an open end of carton 2 showing corrugated insert 3, having multiple ridges and furrows at angles 7 and 6 respectively, and front and rear rows of product rods 5 and 4, respectively. Also shown in this view are portions of carton 2 including side panel 9, front panel 10, top end panel 13, top tab panel 14, fold lines 22, 23, 25, 26, and 27, tab slot 19, and hanger holes 20 and 21. Carton 2 provides an enclosure for containing and protecting rods 4 and 5 while insert 3 provides separation and support for rods 4 and 5 and presents them to view through window 17 (and 18 not shown in FIG. 2). Insert 3 is preferably cut diagonally between angles 6 a nd 7 to provide easier access to rods 4 and 5.

Figure 3:
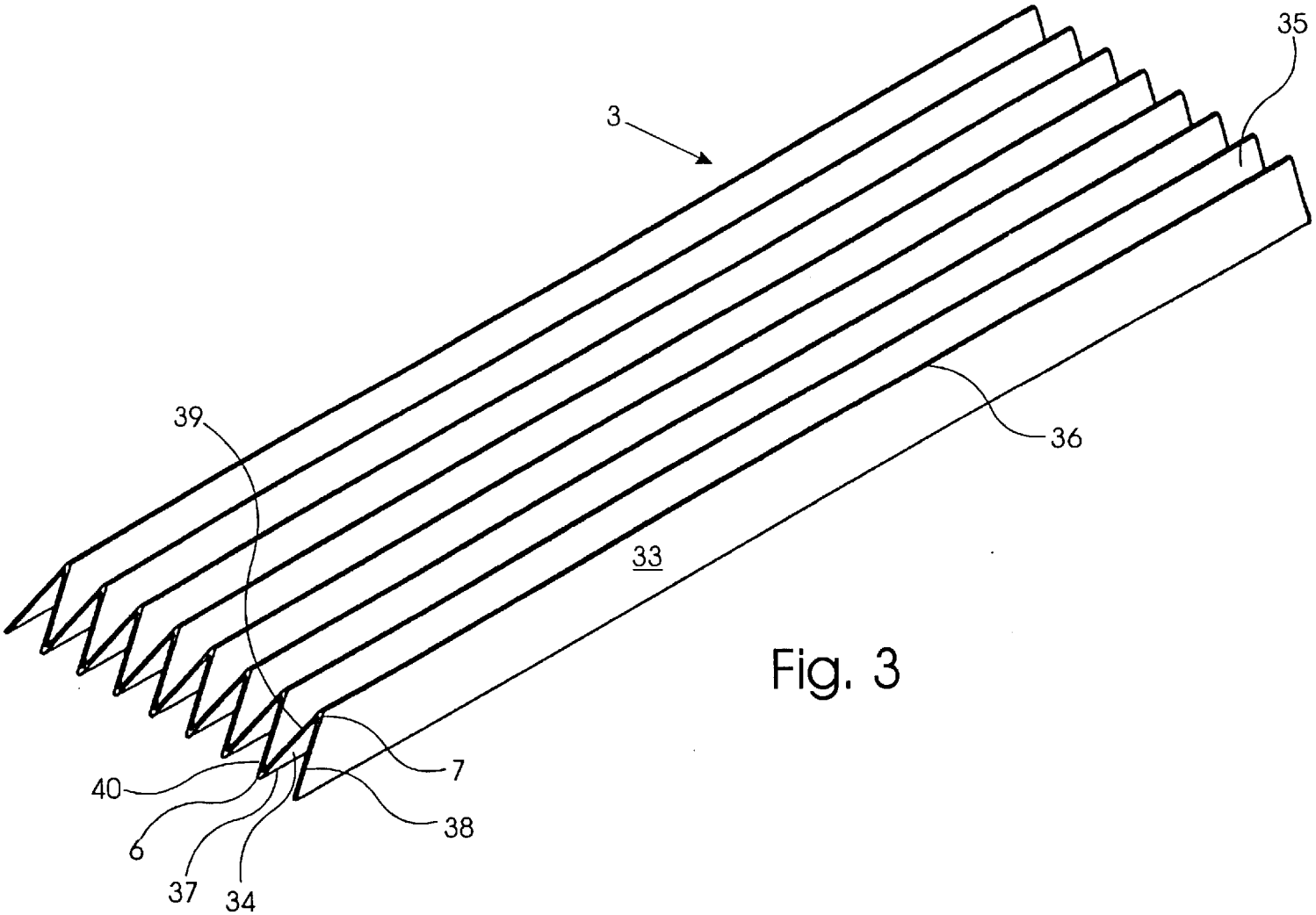
FIG. 3 is a perspective view of the corrugated insert.

FIG. 3 is a perspective view of corrugated insert 3 alone showing replicated panels 33 and 34, panel 35 (which is a replication of panel 33), replicated fold lines 36 and 37 which form ridges and furrows at angles 7 and 6 respectively, and diagonally cut edges 38 and 39.

Figure 4:
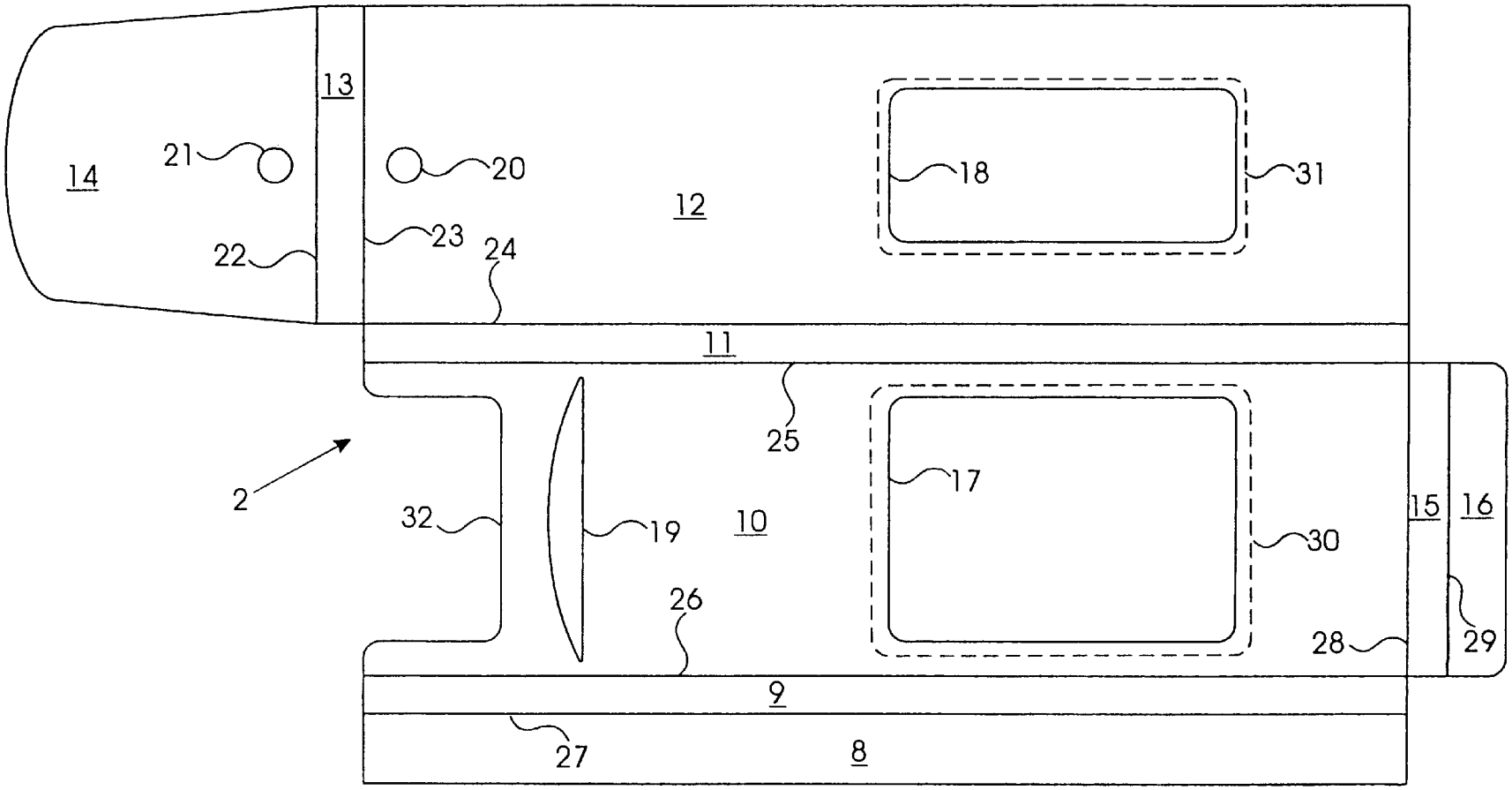
FIG. 4 shows the carton in its unfolded (blank) state.

FIG. 4 is a plan view of carton 2 in its unfolded, or blank, form. The blank for carton 2 comprises a single sheet of material forming front panel 10, rear panel 12, left and right side panels 9 and 11, side tab 8, bottom end panel 15, bottom tab panel 16, top end panel 13, top tab panel 14, front window opening 17, rear window opening 18, tab slot 19, front and rear hanger holes 20 and 21, and cutout 32. The carton blank includes top fold lines 22 and 23, side fold lines 24, 25, 26, and 27, and bottom fold lines 28 and 29. The carton blank may also include transparent window panels 30 and 31 attached to the perimeters of window openings 17 and 18, respectively. Normally, the carton blank is finished on only one (the outer) surface and window panels 30 and 31 are attached to the unfinished surface.

Carton 2 is formed from its blank by folding panels 8, 12, 14 and 16 backward (as seen in FIG. 4) approximately 90° along fold lines 27, 24, 22 and 29, respectively; then folding panels 9, 11, 13 and 15 backward approximately 90° along fold lines 26, 25, 23 and 28, respectively. Panel 8 is then attached, preferably by gluing, to panel 12 to form the carton. Panel 16 may be folded inside panel 12 or optionally attached to panel 12. Later, when the package of FIG. 1 is filled, it is closed by inserting tab 14 into tab slot 19. Cutout 32 provides easy access to the contents of the package when carton 2 is opened.

Figure 5:
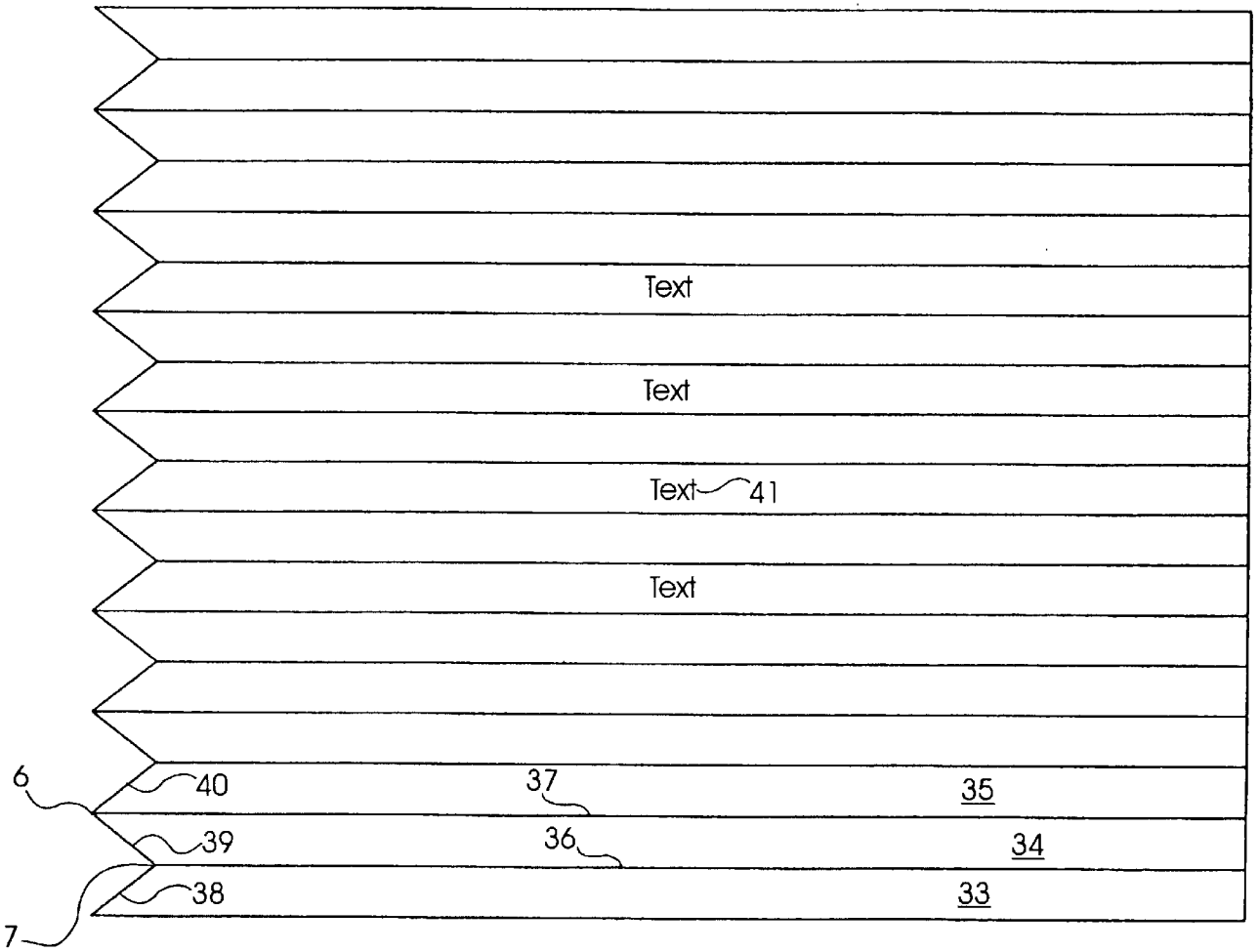
FIG. 5 shows the corrugated insert in its unfolded (blank) state.

FIG. 5 is a plan view of corrugated insert 3 in its unfolded, or blank, form. Insert 3 comprises a single sheet of material, preferably cardboard, having multiple panels which are replications of panels 33 and 34. Panels 33 and 34 comprise a pair of panels which are mirror images of each other and joined by fold line 36. Panel 35 is a member of an adjacent pair of panels and corresponds to panel 33 in the first pair. Panel 35 is connected to panel 34 by fold line 37. Edges 38, 39 and 40 of panels 33, 34 and 35 are cut diagonally to form angles 6 and 7 at fold lines 37 and 36, respectively. Fold lines 36 and 37 may be defined by perforations or by grooves pressed into the material. Insert 3 can be finished on one or both surfaces as needed. Text 41 can be printed on the surfaces of selected replications of panels 34 and 35 preferably to provide information about individual product rods. To form the corrugated insert 3, panel 33 is folded downward (as viewed in FIG. 5) along fold line 36 to form a ridge, and panel 34 is folded upward along fold line 37 to form a furrow or trough. This folding process is repeated for each pair of panels in the blank, resulting in the corrugated insert 3 shown in FIG. 3. The resulting insert 3 has a cross section comprising angles at the ridges and furrows connected by straight line segments. Insert 3 is capable of conforming to a width approximately equal to a distance between side panels 9 and 11, and adept approximately equal to a distance between front panel 10 and rear panel 12. When package 1 of FIG. 1 is assembled and filled with product rods, text 41 appears on the sides of the troughs adjacent to rods 5 (or 4) shown in FIG. 2 and is visible through window 17 (or 18) shown in FIG. 4. The diagonally cut edges 38 and 39 provide easy access to product rods 4 and 5 as shown in FIG. 2.

Figure 6:
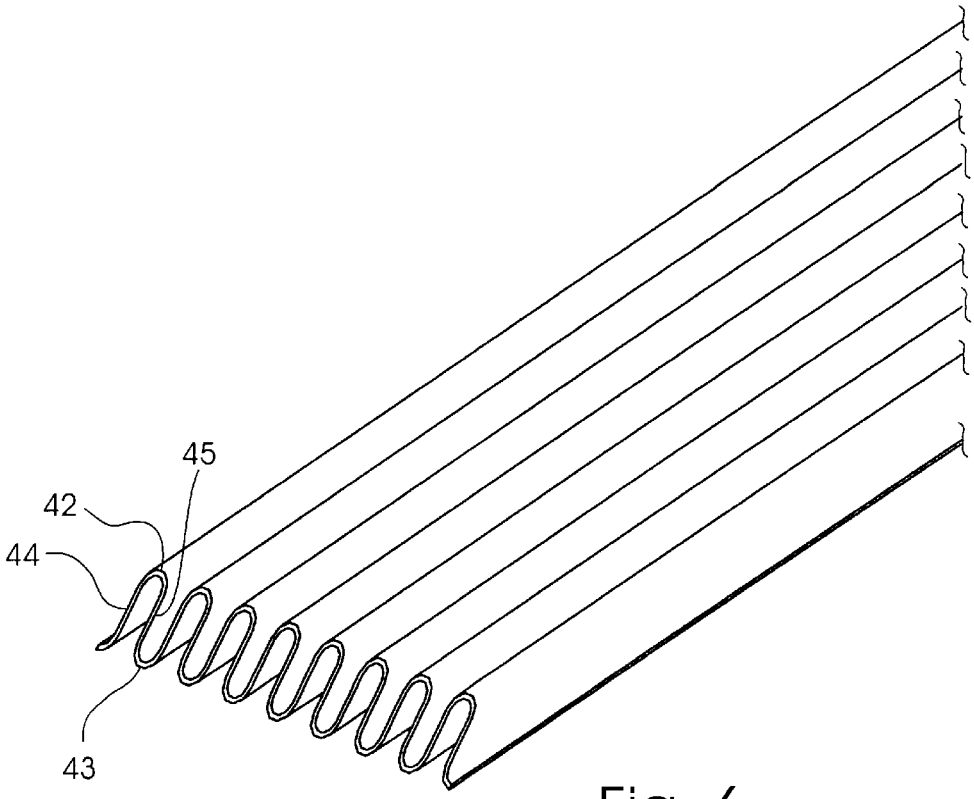
FIG. 6 is a perspective view of the insert with a U-shaped cross section.

Although insert 3 has been described above as accordion pleated (i.e., having a cross section comprising an array of V-shaped elements as shown in FIG. 3), it could also have other shapes. For example, the insert could have a U-shaped cross section comprising an array of U-shaped elements (with adjacent elements alternately inverted) as shown in FIG. 6. In a pure U-shaped cross section, the elements comprise semicircular sections 42 and 43 connected by parallel lines 44 and 45. However, as used herein, the term U-shaped cross section also includes elements wherein sections 42 and 43 are arcs and lines 44 and 45 are not parallel.

Figure 7:
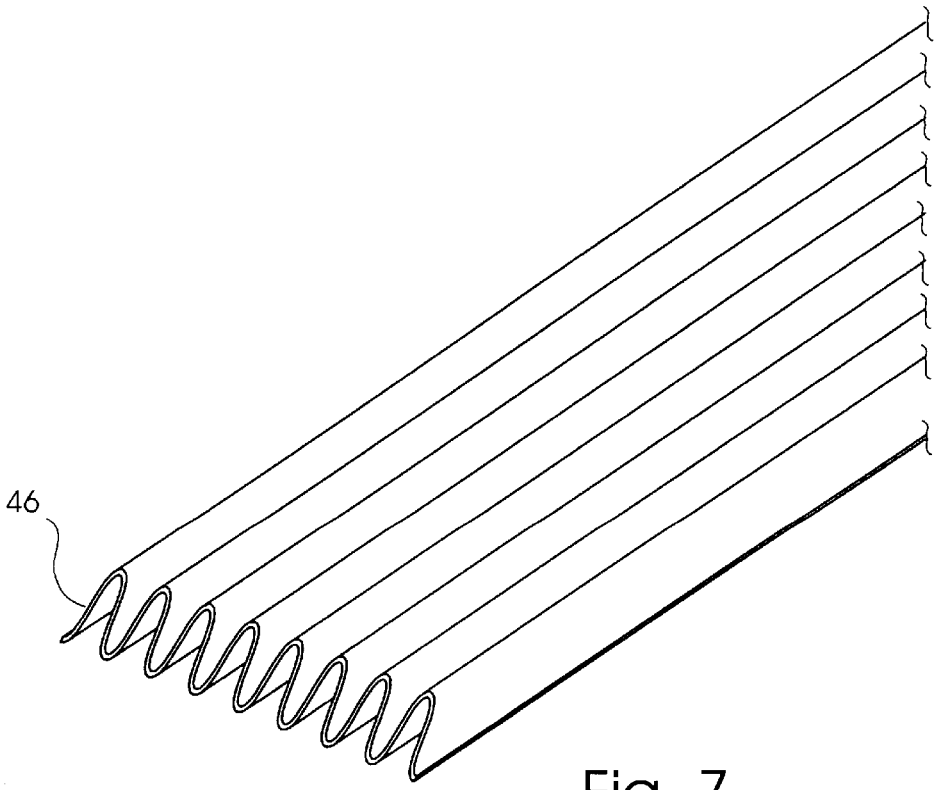
FIG. 7 is a perspective view of the insert with a sinusoidal cross section.

The insert could also have a sinusoidal cross section 46 as shown in FIG. 7. These and other cross sections known in the art can be chosen to optimize ease of manufacturing or to fit the size and shape of the products.

While the invention has been described above with respect to specific embodiments, it will be understood by those of ordinary skill in the art that various changes in form and details may be made therein without departing from the spirit and scope of the invention.

I claim

1. A package for protecting and displaying products, comprising:

a carton having front and rear panels, left and right side panels each having an edge connected to an edge of said front and rear panels, and upper and lower end panels each having an edge foldably connected to an edge of one of said front and rear panels;

a window in said carton; and a corrugated insert within said carton, said insert comprising a single sheet of material further comprising mirror image panels folded alternately in opposite directions to form alternating ridges and furrows across its entire width, said ridges and furrows having open ends adjacent said end panels and said insert conforming to a width approximately equal to the distance between said side panels and a depth approximately equal to the distance between said front and rear panels;

wherein said end panels when unfolded expose said open ends and allow insertion of products into said open ends of both said ridges and forrows.

2. The package of claim 1 wherein said ridges and said furrows have V-shaped cross sections.

3. The package of claim 1 wherein said ridges and said furrows have U-shaped cross sections.

4. The package of claim 1 wherein said insert has a sinusoidal cross section.

5. The package of claim 1 wherein at least one of said front and rear panels contains said window.

6. The package of claim 1 further comprising an upper tab panel and a tab slot, said upper tab panel attached to said upper end panel, and said tab slot formed in said front face panel for receiving said upper tab panel.

7. The package of claim 1 wherein said carton and said insert are each folded from a blank cut from a flat sheet of material.

8. The package of claim 7 wherein said material is cardboard.

9. The package of claim 7 wherein said blank has a finished surface.

10. The package of claim 1 wherein said window comprises a transparent panel attached to said carton.

11. The package of claim 1 wherein said insert includes text printed on a surface.

12. The package of claim 1 wherein said carton includes a hole for hanging said package.

13. The package of claim 1 wherein said insert has a diagonally-cut edge.

* * * * *